US010920619B2

(12) United States Patent
Canelle et al.

(10) Patent No.: US 10,920,619 B2
(45) Date of Patent: Feb. 16, 2021

(54) ANNULAR CASTING AND SHRINK-FITTED PART OF AN AIRCRAFT TURBINE ENGINE

(71) Applicant: SAFRAN AIRCRAFT ENGINES, Paris (FR)

(72) Inventors: Etienne Gerard Joseph Canelle, Moissy-Cramayel (FR); Jacques Marcel Arthur Bunel, Moissy-Cramayel (FR); Faouzi Aliouat, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/446,242

(22) Filed: Jun. 19, 2019

(65) Prior Publication Data

US 2019/0390571 A1 Dec. 26, 2019

(30) Foreign Application Priority Data

Jun. 20, 2018 (FR) ..... 1855461

(51) Int. Cl.
*F01D 25/24* (2006.01)

(52) U.S. Cl.
CPC ..... *F01D 25/243* (2013.01); *F05D 2260/31* (2013.01); *F05D 2260/37* (2013.01)

(58) Field of Classification Search
CPC ..... F01D 25/243; F05D 2260/31; F05D 2260/37; F05D 2230/70
See application file for complete search history.

(56) References Cited

U.S. PATENT DOCUMENTS 4,098,125 A * 7/1978 Lee ..... B01L 3/0224 422/925
5,961,807 A * 10/1999 Daum ..... F01D 25/243 205/118
6,199,453 B1 * 3/2001 Steinbock ..... B23P 19/068 29/452

(Continued)

FOREIGN PATENT DOCUMENTS

EP 1931859 B1 11/2012
EP 1931589 B1 3/2015

(Continued)

OTHER PUBLICATIONS

Preliminary Research Report and Written Opinion received for French Application No. 1855461, dated Mar. 15, 2019, 9 pages (1 page of French Translation Cover Sheet and 8 pages of original document).

*Primary Examiner* — Ninh H. Nguyen
*Assistant Examiner* — Brian Christopher Delrue
(74) *Attorney, Agent, or Firm* — Womble Bond Dickinson (US) LLP

(57) ABSTRACT

A part for a turbine engine, the part having a general annular shape about an axis of revolution, this part including a first annular shrink-fitted mounting flange and comprising an annular row of orifices for the passage of screws, this part being made by casting and including protruding pads required for the control and the manufacture of the part by casting, wherein the pads are located on the flange and in that each comprises a thread configured to engage with an extraction screw of the flange.

17 Claims, 4 Drawing Sheets

(56) References Cited

U.S. PATENT DOCUMENTS

| | | | | |
|---|---|---|---|---|
| 7,198,465 | B1 * | 4/2007 | Ichiryu | F01D 25/243 415/214.1 |
| 7,464,496 | B1 * | 12/2008 | Davies | F41A 21/24 42/75.02 |
| 2004/0049964 | A1 * | 3/2004 | Vais | F41A 21/482 42/75.02 |
| 2007/0264128 | A1 * | 11/2007 | Grudnoski | F01D 25/24 416/244 R |
| 2008/0193289 | A1 * | 8/2008 | Khanin | F01D 9/042 415/209.2 |
| 2011/0311389 | A1 * | 12/2011 | Ryan | F01D 5/18 419/27 |
| 2013/0149159 | A1 * | 6/2013 | Chuong | F01D 25/243 416/220 R |
| 2017/0159935 | A1 * | 6/2017 | Drake | F23R 3/60 |
| 2017/0175801 | A1 * | 6/2017 | Mickelsen | F02C 7/25 |
| 2018/0045066 | A1 * | 2/2018 | Chuong | F16J 15/442 |
| 2018/0265181 | A1 * | 9/2018 | Goverdhan | B64C 11/14 |
| 2020/0123932 | A1 * | 4/2020 | Husband | F23R 3/60 |

FOREIGN PATENT DOCUMENTS

| | | | |
|---|---|---|---|
| EP | 3048270 | A1 | 7/2016 |
| WO | 2016/051080 | A1 | 4/2016 |

* cited by examiner

ANNULAR CASTING AND SHRINK-FITTED PART OF AN AIRCRAFT TURBINE ENGINE

TECHNICAL FIELD

The present invention relates to an annular casting and shrink-fitted part of an aircraft turbine engine

STATE OF THE ART

The state of the art comprises, in particular, documents EP-A1-3 048 270, WO-A1-2016/051080 and EP-B1-1 931 859.

An aircraft turbine engine comprises several annular parts, such as for example casings, abradable coating supports etc. that are coaxial and extend about the longitudinal axis of the turbine engine, which is generally coincident with the rotation axis of the main rotor thereof or of the main rotors thereof.

The casings and abradable supports must be well centred and sealed between them. For this purpose, they are mounted by shrink-fitting with one another. This is particularly important for abradable supports that provide sealing between the fixed and mobile parts of the engine.

To disassemble these parts, a known process is to provide them with extraction sockets. These sockets are installed at regular intervals on annular mounting flanges securing these parts. Screws dedicated to the extraction of parts are screwed into these sockets for the disassembly of the parts from each other. The screws are indeed used such that the tightening torque of the screws is converted into an extraction force that is sufficient to overcome the tightening forces of the parts linked to the shrink-fitting.

These extraction sockets are generally added and crimp-fitted on the flanges, next to the orifices provided on the flange for the passage of the fastening screws of said flange. This is in particular the case for parts made by forging.

However, some parts of a turbine engine can be made by casting. In this case, the casting operation requires the presence of specific pads that protrude from the parts and that have a dual function. Firstly, these pads serve as a reference for the control of the part after manufacturing, and they also serve during the manufacturing of the part. These pads must therefore be kept throughout the lifecycle of the part. However, they are relatively voluminous and are ideally located on the flange of the part to meet the requirements of the casting process.

However, it is currently very difficult, or even impossible, for reasons of space, to have on a same flange of a part obtained by casting, passage orifices for the fastening screws (bolted connections), extraction sockets, casting pads, or even other members such as stiffening ribs.

This problem is accentuated when more than two flanges are applied and fixed to one another. In such a case, one of the shrink-fitted flanges must comprise extraction sockets as well as notches for the passage of the extraction sockets of another flange on which this flange is shrink-fitted.

The present invention proposes a simple, efficient and economical solution to this problem.

PRESENTATION OF THE INVENTION

The invention relates to a part for a turbine engine, this part having a general annular shape about an axis of revolution, this part comprising a first annular shrink-fitted fastening flange and comprising an annular row of orifices for the passage of screws, this part being made by casting and comprising protruding pads necessary for the control and the manufacture of the part by casting, characterised in that said pads are located on said flange and in that each comprises an thread configured to cooperate with an extraction screw of the flange.

The invention is advantageous, as it makes it possible to integrate the extraction socket function according to the prior art with the casting pads. The part therefore does not require actual extraction sockets, which frees up space on the shrink-fitted flange thereof. The pads thus have a dual function.

The part according to the invention can comprise one or more of the following characteristics, taken individually or in combination:

- the part bears an abradable annular coating,
- the flange comprises a first radial face bearing against another flange, and an internal radially cylindrical face shrink-fitted on a radially external cylindrical bearing of this other flange,
- the pads protrude on a second radial face, opposite said first radial bearing face.

The invention also relates to an assembly comprising a part such as described above, and a first annular element extending about said axis, the first flange of the part being shrink-fitted and axially applied against a second annular flange of this first element such that the threads of said pads are aligned with the through-holes of the second flange, these holes having a diameter less than that of said threads.

The assembly according to the invention can comprise one or more of the following characteristics, taken individually or in combination:

- the assembly comprises a second annular element extending about said axis and comprising a third shrink-fitted flange applied axially against the second flange, on the opposite side of the first flange, such that the threads and said through-holes are aligned with the blind holes of the third flange, these holes having a diameter greater than that of said through holes,
- said through holes and/or said blind holes are not threaded,
- said first element is a bearing support and/or said second element is a turbine casing,
- the assembly comprises an annular cavity located at the interface between the first flange and the second flange, and said cavity is configured to connect each thread of said pads to the hole of the second flange,
- said cavity comprises a half portion in recess on a downstream radial face of the second flange, and another half portion in recess on the first radial face of support of the first flange,
- said second flange has a predetermined thickness E intended to be greater than a length L1 of an extension of the screw.

The present invention also relates to an aircraft turbine engine, comprising a part or an assembly such as described above.

The present invention finally relates to a method for disassembling a part in an assembly such as described above, comprising the steps of:

a) inserting an extraction screw in the thread of each pad of the part, b) screwing the extraction screws into the threads until the free ends thereof come to bear against the second flange, c) continuing to screw the extraction screws such that the screwing torque of the screws generates an extraction force of the part with respect to the second flange and to the first element, d) removing the part.

The method can further comprise:

prior to step a), a step of (i) mounting an abutment on the free end of each of the extraction screws, thereby extending them, between steps a) and c), steps of ii) screwing the extraction screws into the threads until the abutments come to bear against the third flange, iii) continuing to screw the extraction screws such that the screwing torque of the screws generate an extraction force of the part and of the first element with respect to the third flange and to the second element, (iv) removing the part and the first element.

The extraction screw used in step c) can comprise the abutment and an extension having a predetermined length L1 that is configured to pass through the threads and a part of the holes. Preferably, the abutment and the extension have a total predetermined length L2.

DESCRIPTION OF THE FIGURES

The invention will be better understood, and other details, characteristics and advantages will appear upon reading the following description, provided by way as a non-limiting example and with reference to the appended drawings, wherein.

DETAILED DESCRIPTION

Figure 1:
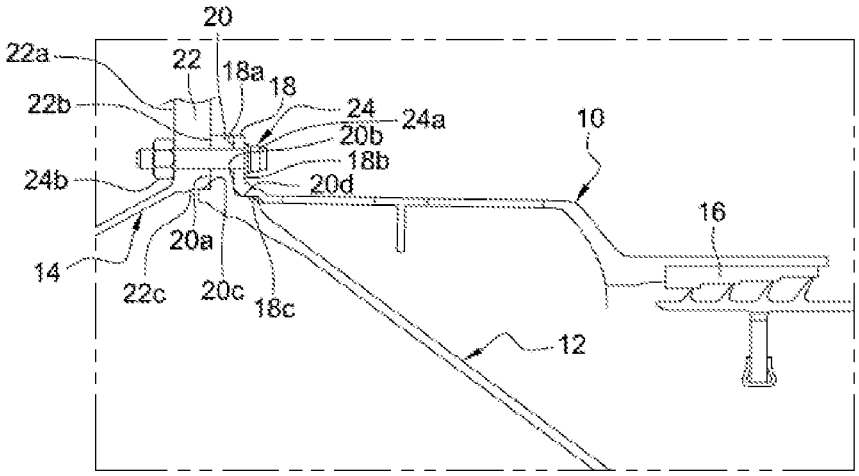
FIG. 1 is a partial schematic axial cross-section view of an aircraft turbine engine.

FIG. 1 is a schematic, partial view of a turbine engine, and more precisely of the rear or downstream portion of the turbine engine, the terms upstream and downstream referring to the direction of the flow of gases in the turbine engine. In the case of a conventional turbine engine, for example a twin-body bypass turbine engine, the gases flow from a fan inside a nacelle outwards and around a gas generator that comprises, in succession, low-pressure and high-pressure compressors, a combustion chamber, high-pressure and low-pressure turbines and a gas exhaust pipe.

In FIG. 1, the references 10, 12 and 14 respectively refer to an annular support of abradable coating, an annular bearing support, and an internal casing of the high-pressure turbine.

These three annular parts are centred on the longitudinal axis of the turbine engine and are assembled to one another by shrink-fitting and attachment of the flanges.

The support 10 has a general cylindrical shape in the represented example and bears an abradable annular coating 16 on the downstream end thereof. The support 10 comprises, at the upstream end thereof, a first flange 18. The flange 18 comprises two radial faces, respectively an upstream bearing face 18*a* and a downstream face 18*b*, and a cylindrical radially internal shrink-fitting surface 18*c*. The face 18*a* and the surface 18*c* are connected to one another.

The support 12 has a general frusto-conical shape flaring out in the upstream direction in the represented example, and is here surrounded by the support 10. It comprises, at the upstream end thereof, a second flange 20. The flange 20 comprises two radial faces, respectively an upstream face 20*a* and a downstream bearing face 20*b*, as well as two cylindrical shrink-fitting bearings, respectively upstream 20*c* and downstream 20*d*. The face 20*a* and the bearing 20*c* are connected to one another, and the face 20*b* and the bearing 20*d* are connected to one another (FIG. 4).

The casing 14 has a general frusto-conical shape flaring out in the downstream direction in the represented example, and comprises, at the upstream end thereof, a third flange 22. The flange 22 comprises two radial faces, respectively a downstream face 22*b* and an upstream face 22*a*, and a cylindrical radially internal shrink-fitting surface 22*c*. The face 22*b* and the surface 22*c* are connected to one another (FIG. 4).

Figure 4:
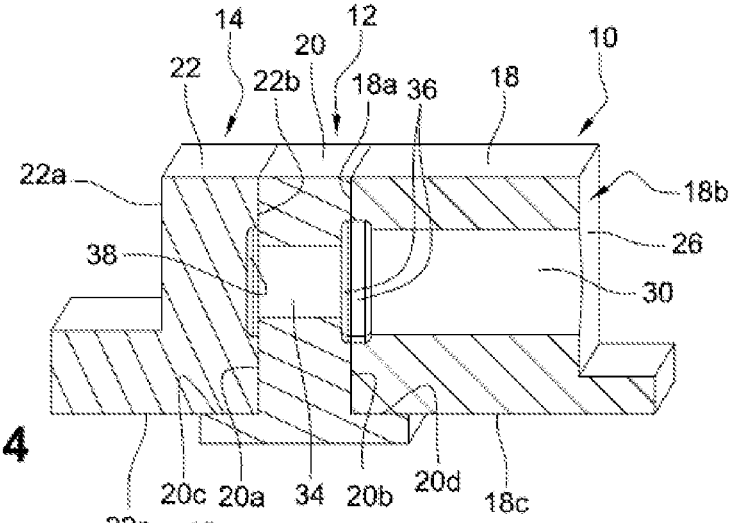
FIG. 4 is a highly schematic, axial, cross-sectional and perspective view of shrink-fitted flanges of an assembly according to the invention.

The flanges 18, 20 and 22 comprise aligned orifices for the passage of fastening screws 24, of which the heads 24*a* bear against, for example, the radial downstream end 18*b* of the first flange 18, and the threaded bodies of which receive the nuts 24*b* that bear against the upstream radial face 22*a* of the third flange 22 (FIG. 4).

In addition to being fastened by bolting, the flanges 18, 20, 22 are shrink-fitted, i.e. they are secured to one another by radial tightening to the other. For this purpose, the part intended to be secured to another part is heated to expand and facilitate the engagement thereof onto the other part. during the cooling thereof, the part shrinks and tightens radially against the other part.

In the represented example, the flange 18 is shrink-fitted by the surface 18*c* thereof on the bearing 20*d* of the flange 20, and the flange 22 is shrink-fitted by the surface 22*c* thereof on the bearing 20*c* of the flange 20.

The flange 20 is interposed between the flanges 18, 22 and the radial faces 20*a*, 20*b* thereof bear against the flanges 22, 18 respectively, and therefore does not comprise any protrusions.

Figure 3:
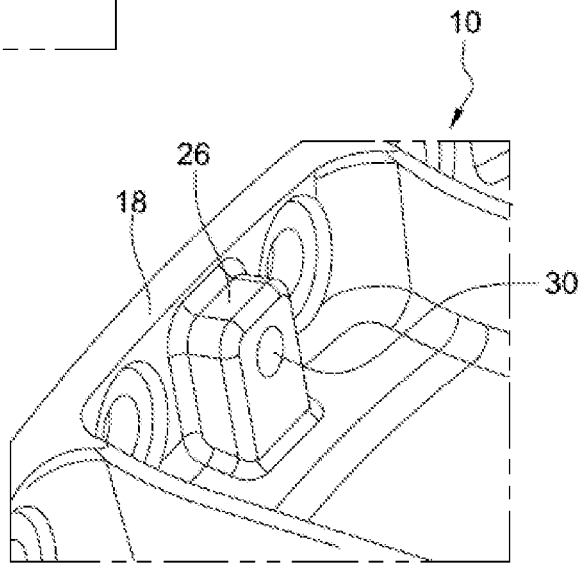
FIG. 3 is a partial schematic, perspective view of an annular flange of a part according to the invention.

According to the invention, one of the other parts, such as, for example, the support 10, is made by casting and comprises on the radial downstream face 18*b* thereof, pads 26 that protrude (as seen in FIG. 3) and are necessary for the control of the part and for the manufacture of the part. The pads 26 have a general parallelepiped shape in the represented example.

Moreover, because of the shrink-fitting of the flanges 18, 20, 22, these flanges must be equipped with extraction means, i.e. means able to generate an axial spacing force between two parts in order to extract them from one another by de-shrink-fitting them.

Figure 2:
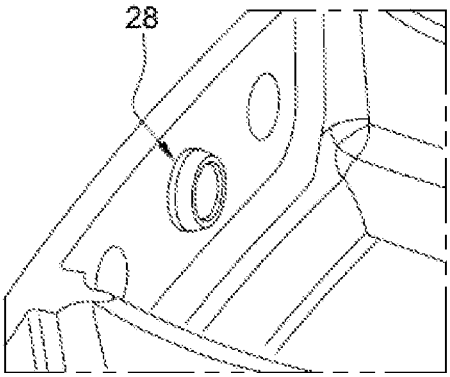
Fig. 2 PRIOR ART
FIG. 2 is a partial schematic, perspective view of an annular flange of a part according to the prior art.

Conventionally, these extraction means comprise additional sockets 28, shown in FIG. 2. These sockets 28 are mounted by crimping in the orifices of a flange and receive screws that are intended to bear against the flange adjacent to the flange with the sockets, so as to exert the abovementioned spacing force.

According to the invention, the flange that bears the pads 26 does not comprise extraction sockets 28 as the function of these sockets is integrated to the pads. Indeed, the pads 26 comprise threads 30 for the screwing of the extraction screws, as seen in FIG. 3.

The threads 30 go through and are threaded to engage with the extraction screws that are intended to bear against at least one of the other flanges 20, 22 of the assembly. The threads 30 are oriented axially, i.e. they are parallel to the axis of revolution and assembly of the parts. The extraction screws are screwed from the downstream direction into the threads 30 in the represented example.

FIGS. 5*a* to 5*e* illustrate the disassembly steps of a first embodiment of a method according to the invention, with only the support 10 being disassembled and thus separated from the other two parts (support 12 and casing 14).

Each extraction screw 32 has a general cylindrical shape and comprises a threaded body 32*b*, of which one longitudinal end is connected to a driving head 32*c* and of which one opposite longitudinal end comprises an axial extension 32*a* having a diameter less than that of the body.

It is observed that the flange 20 comprises through-holes 34 aligned with the threads 30 of the flange 18. These holes 34 are not threaded and have an internal diameter that is less than that of the threads 30, and comprised between the diameter of the extension 32*a* and the diameter of the body 32*b* of the screw 32. It is also observed that each thread 30 is connected to a hole 34 by an annular cavity 36 which is located at the interface between the flanges 18, 20. This cavity 36 has a diameter that is greater than the diameters of the hole 34 and of the thread 30 and comprises a half portion formed by a recess on the downstream radial face 20*b* of the flange 20, and another half portion formed by a recess on the upstream radial face 18*a* of the flange 18 (FIG. 4).

The flange 22 comprises blind holes 38 aligned with the holes 34 and the threads 30. These holes 38 are not threaded and here have an inner diameter greater than the inner diameter of the holes 34.

The threads 30 are, for example, three in number regularly distributed about the axis of the support 10. It is therefore understood that the flange 20 in this case comprises three holes 34 and that the flange 22 comprises three holes 38.

Figure 5A:
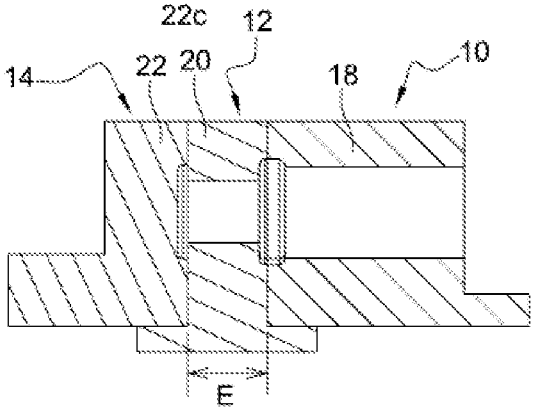
FIGS. 5*a* to 5*e* are highly schematic, axial, cross-sectional views of the assembly of FIG. 4, illustrating the disassembly steps, and in particular the extraction of a first flange.
Figure 5A:
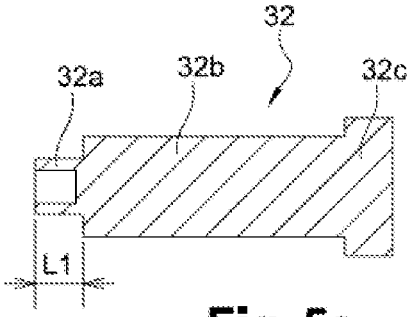
Figure 5B:
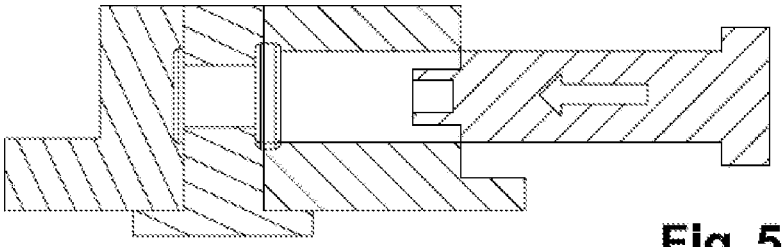
Figure 5C:
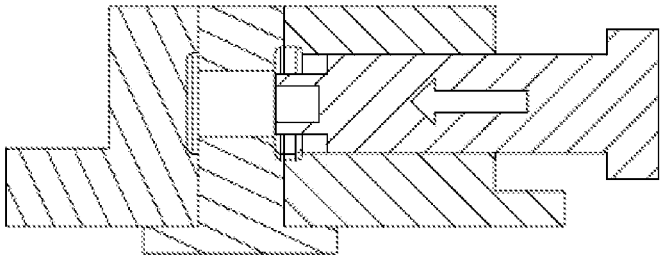

Each screw 32 is first aligned on the axis of a thread 30 and then engaged by the extension 32*a* thereof in this thread 30 (FIGS. 5*a* and 5*b*). The screw is screwed in the thread by means of a suitable tool engaging with the driving head 32*c* thereof, until the extension 32*a* engages itself in the hole 34 and that the end of the body 32*b* connected to the extension bears against the bottom of the recess of the upstream radial face 20*b* of the flange 20 (FIGS. 5*c* and 5*d*).

It thus suffices to apply a sufficient tightening torque to the screw 32 such that an extraction force is applied to the support (arrow F1) in order to axially space the flanges 18, 20, until the surface 18*c* of the flange is no longer in contact with the bearing 20*d* of the flange 20.

Figure 5D:
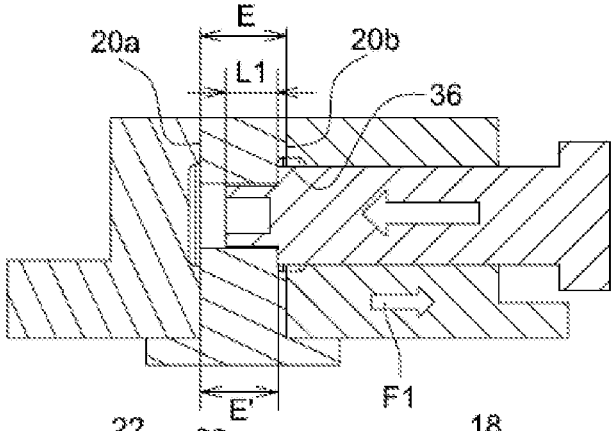
Figure 5E:
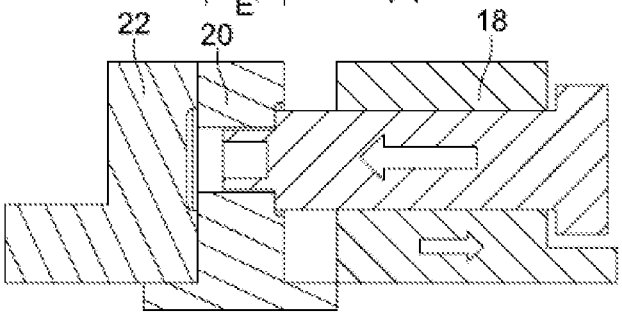

This operation can be here made possible by the fact that the extension 32*a* has a length L1 less than the thickness E of the flange 20 (and more precisely, L1 is less than the remaining thickness E' between the bottom of the recess forming the cavity 36 on the face 20*b* and the opposite face 20*a*—FIG. 5*d*) and does not risk coming into contact with the flange 22 during screwing. It is also understood that, for the simple disassembly of the support 10, this extension 32*a* is not obligatory, since it has no particular utility during this extraction.

FIGS. 6*a* to 6*h* illustrate another embodiment of the method according to the invention, which consists here of extracting the flanges 18, 22 from the flange 20 and thus to entirely disassemble the assembly.

For this purpose, the same screw 32 is used, but here it is equipped with an abutment 40 which is mounted removable on the extension 32*a*. This abutment has a general cylindrical shape and is axially aligned with the extension 32*a* and the body 32*b* of the screw, the outer diameter of this abutment being similar to that of the extension and thus less than that of the body.

Preferably, the total length L2 of the abutment 40 and of the extension 32*a* is greater than the thickness E (E') of the flange 20 such that the abutment and the extension can be inserted in the hole 34 and pass through it.

Figure 6A:
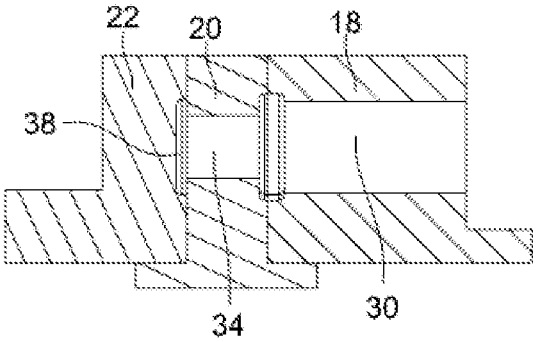
FIGS. 6*a* to 6*h* are highly schematic, axial, cross-sectional views of the assembly of FIG. 4, illustrating the disassembly steps, and in particular the extraction of a second flange and then of a first flange.
Figure 6A:
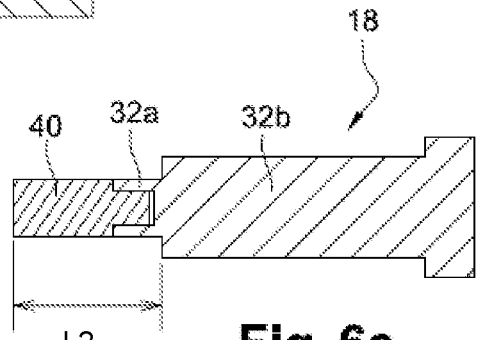
Figure 6B:
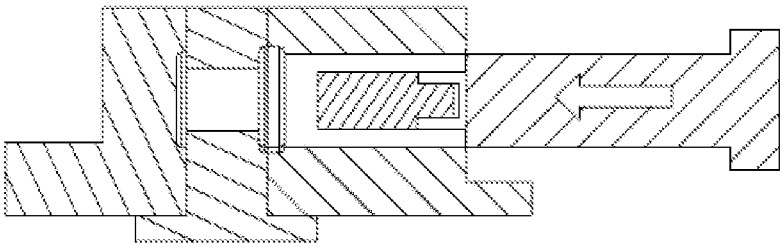
Figure 6C:
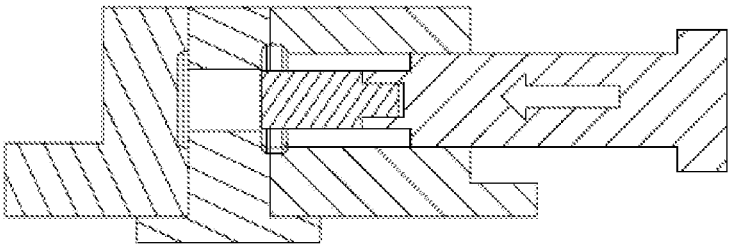
Figure 6D:
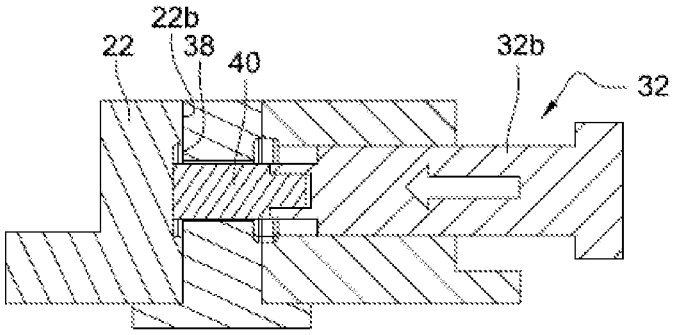
Figure 6E:
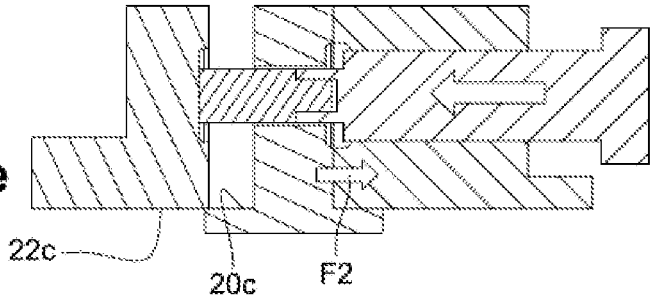
Figure 6F:
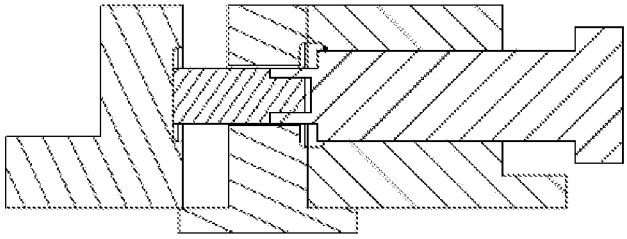

Each screw 32 is first aligned with the axis of a thread 30 and then engaged by the extension 32*a* thereof in this thread 30 (FIGS. 6*a* and 6*b*). The screw is screwed into the thread until the abutment 40 and the extension 32*a* engage in the hole 34 and this abutment bears against the bottom of the blind hole 38 of the downstream radial face 22*b* of the flange 22 (FIGS. 6*c* and 6*d*).

It thus suffices to apply a sufficient tightening torque to the screw 32 such that an extraction force is applied to the support (arrow F2) in order to axially space the flanges 18, 20, on the one hand, from the flange 22, on the other hand, until the surface 22*c* of the flange 22 is no longer in contact with the bearing 20*c* of the flange 20.

Figure 6G:
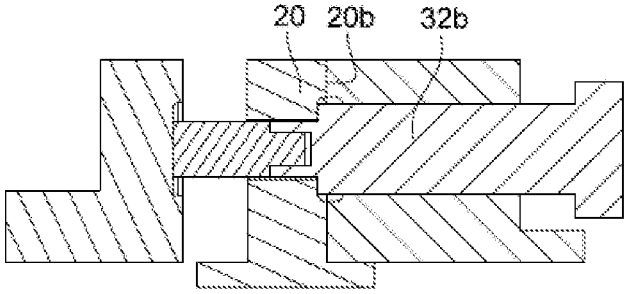

The screw 32 is again screwed in the thread 30 until the end of the body 32*b* connected to the extension 32*a* bears against the downstream radial face 20*b* of the flange 20 (FIG. 6*g*).

Figure 6H:
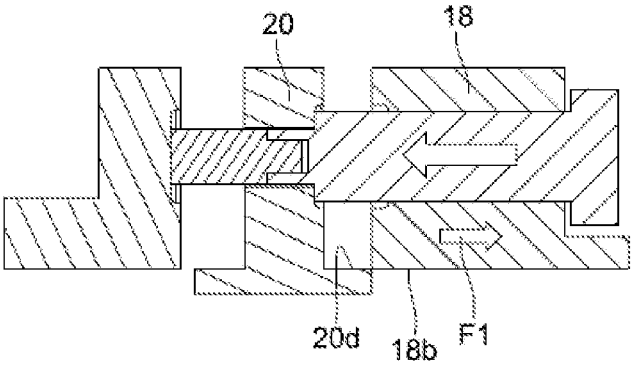

It thus suffices to apply a new sufficient tightening torque to the screw 32 such that an extraction force is applied to the support (arrow F1) for the axial spacing of the flanges 18, 20, until the surface 18*c* of the flange 18 is no longer in contact with the bearing 20*d* of the flange 20 (FIG. 6*h*).

The invention claimed is:

1. A part for a turbine engine, the part having a general annular shape about an axis of revolution, the part comprising a first annular shrink-fitted fastening flange and comprising an annular row of orifices for the passage of screws, the part being made by casting and comprising protruding pads necessary for the control and the manufacture of the part by casting, wherein said protruding pads are located on said flange and in that each comprises an thread configured to engage with an extraction screw of the flange, wherein the part bears an abradable annular coating.

2. The part according to claim 1, wherein the flange comprises a first radial face bearing against another flange, and an internal radially cylindrical face shrink-fitted on a radially external cylindrical bearing of the another flange.

3. The part according to claim 2, wherein the protruding pads protrude on a second radial face, opposite said first radial bearing face.

4. An assembly comprising:

a part for a turbine engine, the part having a general annular shape about an axis of revolution, the part comprising a first annular shrink-fitted fastening flange and comprising an annular row of orifices for the passage of screws, the part being made by casting and comprising protruding pads necessary for the control and the manufacture of the part by casting, wherein said protruding pads are located on said flange and in that each comprises an thread configured to engage with an extraction screw of the flange, and a first annular element extending about said axis, the first flange of the part being shrink-fitted and axially applied against a second annular flange of the first element such that the threads of said protruding pads are aligned with the through-holes of the second flange, these holes having a diameter less than that of said threads.

5. The assembly according to claim 4, wherein the assembly comprises a second annular element extending about said axis and comprising a third shrink-fitted flange applied axially against the second flange, on the opposite side of the first flange, such that the threads and said through-holes are aligned with the blind holes of the third flange, these holes having a diameter greater than that of said through holes.

6. The assembly according to claim 4, wherein said through-holes and/or said blind holes are not threaded.

7. The assembly according to claim 4, wherein said first element is a bearing support and/or said second element is a turbine casing.

8. The assembly according to claim 4, wherein the assembly comprises an annular cavity located at the interface between the first flange and the second flange, and said cavity is configured to connect each thread of said protruding pads to the hole of the second flange.

9. The assembly according to claim 8, wherein said cavity comprises a half portion in recess on a downstream radial face of the second flange, and another half portion in recess on the first radial bearing face of the first flange.

10. The assembly according to claim 4, wherein said second flange has a predetermined thickness E intended to be greater than a length L1 of an extension of the screw.

11. An aircraft turbine engine, comprising:

a part for a turbine engine, the part having a general annular shape about an axis of revolution, the part comprising a first annular shrink-fitted fastening flange and comprising an annular row of orifices for the passage of screws, the part being made by casting and comprising protruding pads necessary for the control and the manufacture of the part by casting, wherein said protruding pads are located on said flange and in that each comprises an thread configured to engage with an extraction screw of the flange, and a first annular element extending about said axis, the first flange of the part being shrink-fitted and axially applied against a second annular flange of the first element such that the threads of said protruding pads are aligned with the through-holes of the second flange, these holes having a diameter less than that of said threads.

12. A method for disassembling a part for a turbine engine, the part having a general annular shape about an axis of revolution, the part comprising a first annular shrink-fitted fastening flange and comprising an annular row of orifices for the passage of screws, the part being made by casting and comprising protruding pads necessary for the control and the manufacture of the part by casting, wherein said protruding pads are located on said flange and in that each comprises an thread configured to engage with an extraction screw of the flange, wherein the part bears an abradable annular coating, the method comprising the steps of:

a) inserting the extraction screw in the thread of each protruding pad of the part, b) screwing the extraction screws into the threads until the free ends thereof come to bear against the second flange, c) continuing to screw the extraction screws such that the screwing torque of the screws generates an extraction force of the part with respect to the second flange and to the first element, d) removing the part.

13. The method according to claim 12, further comprising prior to step a), a step of (i) mounting an abutment on the free end of each of the extraction screws, thereby extending them, between steps a) and c), steps of (ii) screwing the extraction screws into the threads until the abutments come to bear against the third flange, iii) continuing to screw the extraction screws such that the screwing torque of the screws generates an extraction force of the part and of the first element with respect to the third flange and to the second element, (iv) removing the part and the first element.

14. The method according to claim 13, characterised in that the extraction screw used in step c) comprises the abutment and an extension having a predetermined length L1 that is configured to pass through the threads and a part of the holes;

and in that the abutment and the extension have a total predetermined length L2.

15. The part according to claim 1, wherein the part of turbine engine is an annular casting part.

16. The part according to claim 15, wherein the protruding pads are integrate directly to said casting part.

17. The part according to claim 1, the protruding pads have a general parallelepiped shape.

* * * * *